United States Patent [19]

Loeppky et al.

[11] Patent Number: 5,074,556

[45] Date of Patent: Dec. 24, 1991

[54] TABLE TOP GAME

[76] Inventors: Edward Loeppky, 11840 105th St. #14, Edmonton, Alberta, Canada, T5J 2N2; Ron Charbonneau, #212 4505-137 Ave., Edmonton, Alberta, Canada, T5A-3S8

[21] Appl. No.: 570,850

[22] Filed: Aug. 22, 1990

[51] Int. Cl.[5] ..... A63F 7/06

[52] U.S. Cl. ..... 273/85 R; 273/126 R; 273/129 R

[58] Field of Search ..... 273/85 R, 85 F, 119 R, 273/119 A, 118 R, 118 A, 126 R, 126 A, 129 R, 129 K, 129 L; D21/18

[56] References Cited

U.S. PATENT DOCUMENTS

| | | | |
|---|---|---|---|
| D. 150,249 | 7/1948 | Parrilla et al. | 273/85 R X |
| 1,195,173 | 8/1916 | Beamer et al. | 273/118 R |
| 2,824,739 | 2/1958 | Frank | 273/126 R |
| 2,981,542 | 4/1961 | Weiss | 273/85 F |
| 3,202,427 | 8/1965 | Patent | 273/126 R |
| 3,214,171 | 10/1965 | Luchsinger | 273/85 R |
| 3,391,933 | 7/1968 | Cooper | 273/126 R X |
| 3,554,549 | 1/1971 | Grabowski | 273/126 R X |
| 3,865,377 | 2/1975 | Cooper et al. | 273/126 R |
| 3,913,918 | 10/1975 | Trachtman | 273/126 R |
| 4,094,506 | 6/1978 | Morrison et al. | 273/126 R X |
| 4,261,568 | 4/1981 | Such | 273/85 R |
| 4,765,622 | 8/1988 | Rienzo | 273/85 R |
| 4,872,679 | 10/1989 | Bohaski et al. | 273/126 R X |

FOREIGN PATENT DOCUMENTS

| | | | |
|---|---|---|---|
| 366074 | 12/1922 | Fed. Rep. of Germany | 273/85 A |
| 1320633 | 1/1963 | France | 273/126 R |
| 997697 | 2/1983 | U.S.S.R. | 273/85 R |
| 507087 | 6/1939 | United Kingdom | 273/85 R |

*Primary Examiner*—William H. Grieb
*Assistant Examiner*—Sebastiano Passaniti
*Attorney, Agent, or Firm*—Terry M. Gernstein

[57] ABSTRACT

A table game is similar to ice hockey, and includes a deflector element located in the slot area in front of each goal. The deflector element is diamond shaped and is sized to be wider than the slot area, and extends from the blue line defining the offensive zone in which the deflector element is located to near the crease area of the goal of that offensive zone. The game is played using shots and penalty shots, and the game includes a minimum number of small loose parts.

15 Claims, 4 Drawing Sheets

TABLE TOP GAME

TECHNICAL FIELD OF THE INVENTION

The present invention relates to the general art of games, and to the particular field of table games.

BACKGROUND OF THE INVENTION

The game of ice hockey has been known for centuries, and, in recent years, has enjoyed tremendous popularity. Concomitant to this increasing popularity of the actual game is the increasing popularity of board and table games which use sticks and objects which are struck towards a goal in the manner of hockey-type games.

While extremely popular, many of these board and table games have several drawbacks which inhibit the popularity and commercial success thereof. For example, some of these games have many small and loose parts which tend to get lost thereby inhibiting the playing of the game. Worse, such small and loose parts may be dangerous to small children.

Many board games using struck objects are too easy and tush players tend to lose interest after a short period of play. Still other such games place too much emphasis on skill, and less skilled, or younger, players tend to shy away from such games, especially if skilled or older players are involved.

Some games use electronics to simulate play, but such games are often expensive and do no truly match the skills and luck of one player against the skills and luck of another player.

Therefore, there is a need for a new table top game which is based on ice hockey, yet which will permit a less skilled player to have a chance of defeating a more skilled player due to an element of luck, and which has a minimum number of loose parts.

OBJECTS OF THE INVENTION

It is a main object of the present invention is to provide a new table top game which is based on ice hockey.

It is another object of the present invention to a new table top game which is based on ice hockey, yet which will permit a less skilled player to have a chance of defeating a more skilled player due to an element of luck.

It is another object of the present invention to a new table top game which is based on ice hockey, yet which will permit a less skilled player to have a chance of defeating a more skilled player due to an element of luck, and which has a minimum number of loose parts.

SUMMARY OF THE INVENTION

These, and other, objects are achieved by a new table top game which has a playing surface that resembles an ice hockey rink, but also includes a resilient deflector element in front of each goal. The deflector elements have top surfaces which are raised above the playing surface, and are sized and located to guard the goals so a shot on goal may be blocked thereby. This introduces an element of luck into the game and assists a player that is less skilled in goal tending to defeat a player that is a skilled shooter.

The game includes a one-piece monolithic rink-like base so the number of small parts which may be subject to loss is minimized, and thus the game includes a minimum number of loose parts. The only parts which are not part of the one-piece base are hockey sticks and a playing puck.

The game is played by each player choosing a goal to defend, and one player initially placing a puck on top of the deflector element in front of the goal he has chosen to defend. The puck is then initially struck in the direction of the opposing player's goal, located on the opposite end of the base. If the struck puck does not go into that opposite goal, and comes to rest in the playing area, the other player hits that at rest puck toward the first player's goal. Play continues in this manner until one of the players hits the puck into the other player's goal. The player defending that goal has thus been scored upon in the manner of ice hockey, and continues play by placing the puck on top of the deflector element located in front of his goal and hitting it towards the opposing player's goal.

The game continues in this manner until one player reaches a certain number of goals, or a preselected time expires, or until a total number of goals is scored, or until a sudden-death goal has bee scored, or the like. The rules can contain provisions for penalty shots, and the like.

BRIEF DESCRIPTION OF THE DRAWING FIGURES

DETAILED DESCRIPTION OF THE PREFERRED EMBODIMENT OF THE INVENTION

Figure 1:
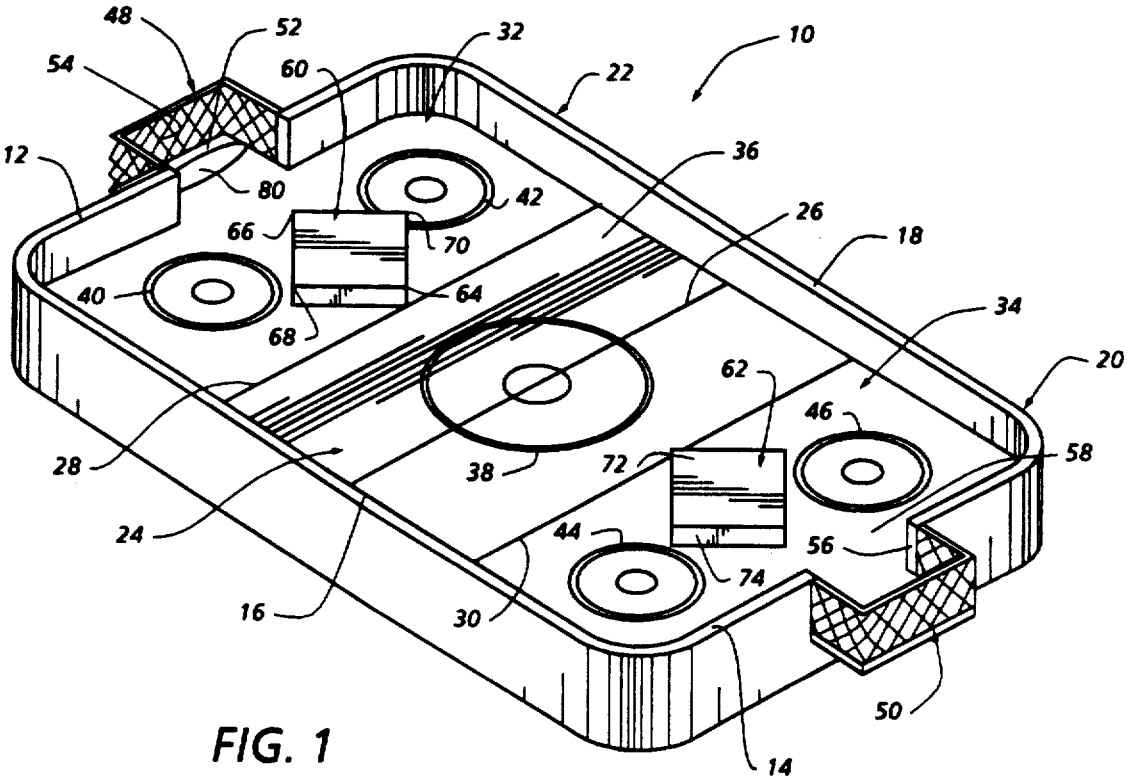
FIG. 1 is a top perspective view of the one-piece monolithic base of the table top game embodying the present invention.

Shown in FIGS. 1–4 is a one-piece, monolithic base 10 used to play a table top game which is based on ice hockey. The monolithic and one-piece nature of the base, not only facilitates manufacture thereof, it permits the game to have a minimum number of loose parts.

The base is intended to resemble an ice hockey rink, and thus is rectangular in peripheral shape to include two ends 12 and 14, and two sides 16 and 18 which are connected to the ends by rounded corners, such as corner 20. A monolithic, one-piece wall 22 surrounds the perimeter of the base, and extends upward from a playing surface 24. The wall is formed of plastic or other such material which has some resiliency, and the playing surface is also formed of a plastic material that has a low coefficient of friction to facilitate the playing of the game, as will be understood from the ensuing discussion.

The playing surface is divided into various areas by a center red line 26 which extends widthwise across the playing surface from one side 16 to the other side 18 and is located midway between the ends 12 and 14 to thus define a transverse centerline of the playing area as defined by the ends 12 and 14 and the sides 16 and 18. Two blue lines 28 and 30 are located on opposite sides of the centerline 26, and define with the sides and adjacent end offensive (and hence defensive) zones, 32 and 34 between the closest end and that blue line. The blue lines also co-operate to define a neutral zone 36 therebetween and which contains the red line. These zones are used to play the game.

A center faceoff circle 38 is defined in the neutral zone and is centered on the redline and on a longitudinal centerline of the base which longitudinal centerline extends from one end to the other and is located midway between the sides 16 and 18. The center of the center faceoff circle 38 is thus located at the center of the base.

Four wing faceoff circles 40, 42, 44 and 46 are also defined on the playing surface to be located adjacent to each rounded corner. In correspondence with the rules of ice hockey, the wing face off circles 40 and 46 are located on the right wing areas of the playing surface, while face off circles 42 and 44 are located in the left wing areas of the playing surface. The wing circles are all of equal peripheral size, and the wing face off circles in a common offensive zone are centered on a line that is parallel with the blue line defining that offensive zone. Corresponding right wing face off circles are also centered on a line that is parallel with the playing surface longitudinal centerline.

Figure 2:
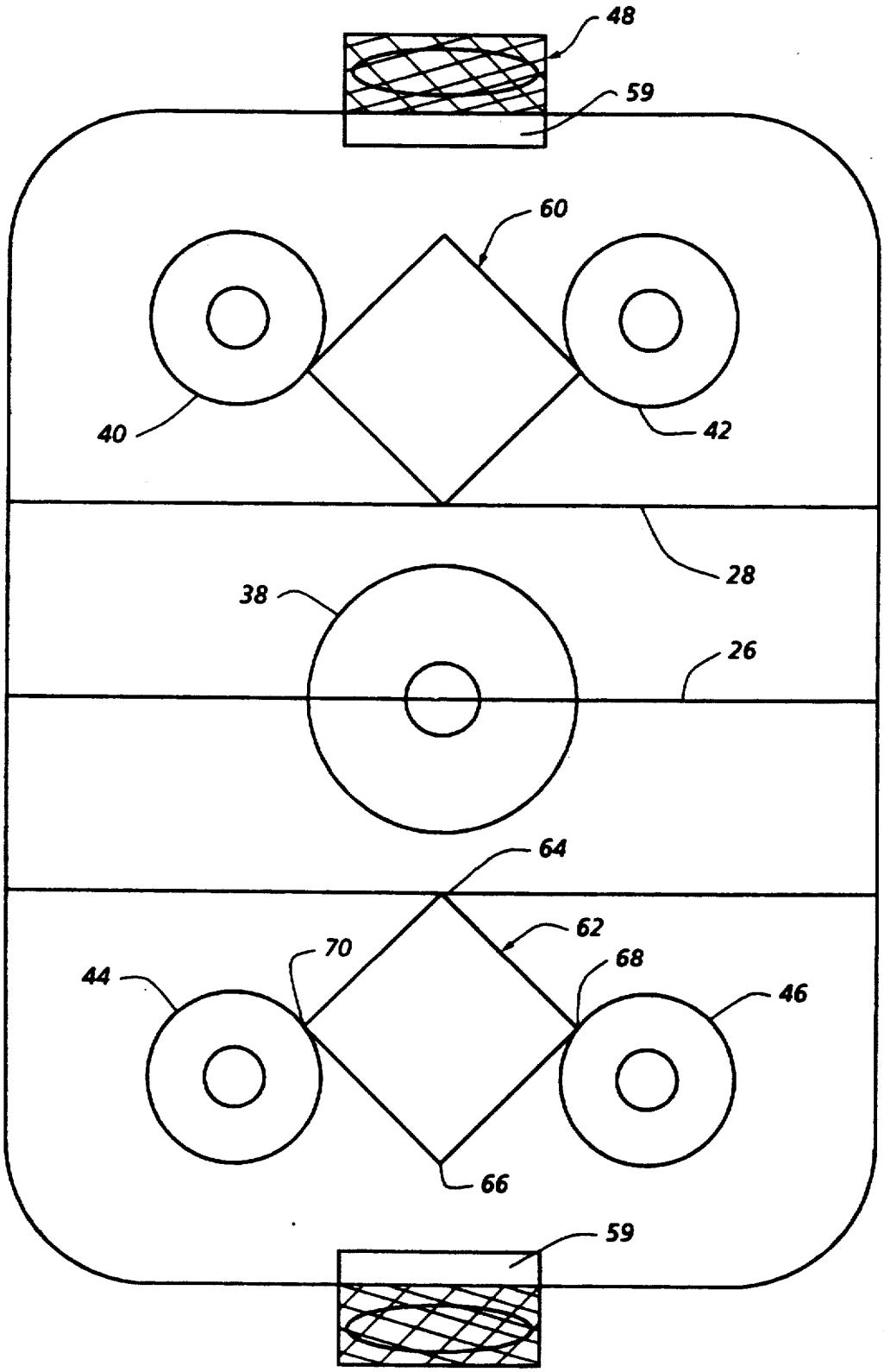
FIG. 2 is a top plan view thereof.

The base further includes goal 48 and 50 defined through ends 12 and 14 respectively and which are centered on the playing surface longitudinal centerline. Each of the goals includes a rectangular floor 52 which is coplanar with the playing surface 24 and extends outwardly therefrom along the playing surface longitudinal centerline, and a net 54 which extends around three sides of the rectangular floor 52. Each goal has a goal mouth 56 defined through the respective end to open into the playing surface and toward the opposite end. The side faceoff circles are located on each side of a rectangular slot area 58 which is defined by the goal mouth and the blue line adjacent to that goal. The width of the slot area is defined by the width of the goal mouth, and the length of the slot area is defined by the distance between the end and the adjacent blue line. The slot area is rectangular but is not marked per se as is the case in an actual ice hockey game. The wing face off circles are located outside of the slot area. As shown in FIG. 2, a goal crease 59 is defined in front of each goal.

As is best shown in FIGS. 1 and 2, two monolithic, one-piece diamond-shaped resilient deflector elements 60 and 62 are located in the slot area adjacent to each goal. Each of the deflector elements has a forward corner 64 located on the corresponding blue line, a rear corner 66 located adjacent to the corresponding goal, a right wing corner 68 contacting the right wing faceoff circle and a left wing corner 70 contacting the left wing faceoff circle. As shown in FIG. 2, the rear corner of each deflector element is located on a line which is tangent to both of the wing circles in that offensive zone, and the wing corners of the deflector elements extend out of the slot area. Each deflector element includes a top surface 72 which is raised above the playing surface and includes edges, such as edge 74, connecting the top surface 72 to the playing surface. The deflector elements thus block access to the goal mouth from the slot area and from areas which are extensions or projections of the slot area. As will be understood from the ensuing discussion, this blocking effect introduces an element of luck into the game and will assist a defensive player in protecting his goal from an offensive player in the manner of a hockey goalie. Preferably, the deflector elements are formed of hard rubber-like material or plastics-type material.

Each goal has a puck catcher depression 80 defined in the floor thereof. The depression forms a dimple in the floor and serves a purpose that will be evident from the ensuing discussion.

Figure 5:
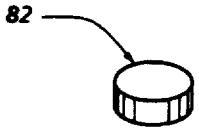
FIG. 5 is a top perspective view of a puck used in conjunction with the base shown in FIGS. 1–4.
Figure 6:
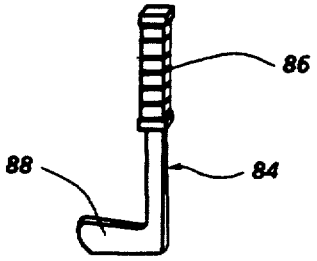
FIG. 6 is a front perspective view of a hockey-type stick used in conjunction with the base shown in FIGS. 1–4.

As best shown in FIGS. 5 and 6, the game also includes a playing piece 82 that is in the shape of a hockey puck and a playing piece 84 that is in the shape of a hockey stick. The playing pieces 82 and 84 are sized to be used in conjunction with a table top game, with the piece 82 being formed of resilient rubber-like material and the playing piece 84 being formed of a wood-like material. The piece 84 includes a handle section 86 and a blade section 88 which is shown as being planar but could be curved if desired in the manner of a normal ice hockey stick.

Figure 3:
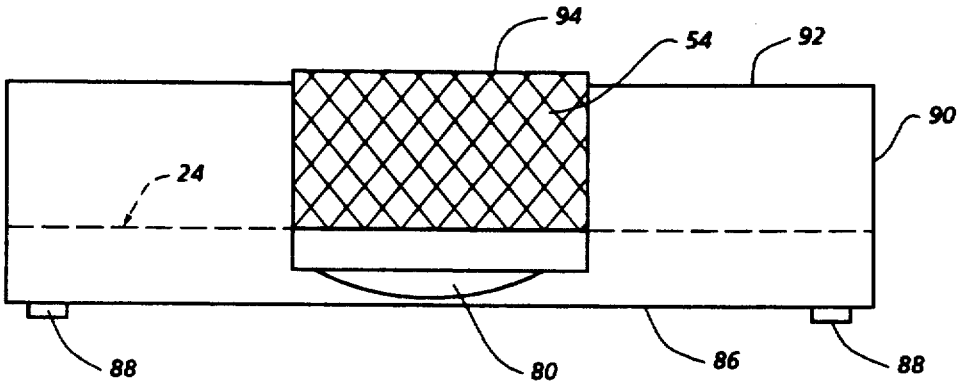
FIG. 3 is an end elevational view thereof, with the end opposite being a mirror image of the end shown in FIG. 3.
Figure 4:
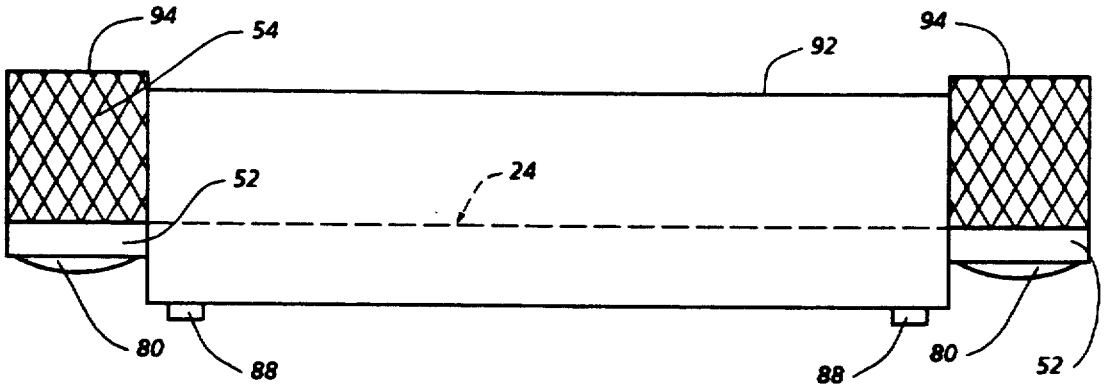
FIG. 4 is a side elevational view thereof, the side opposite being a mirror image of the side shown in FIG. 4.
Figure 7:
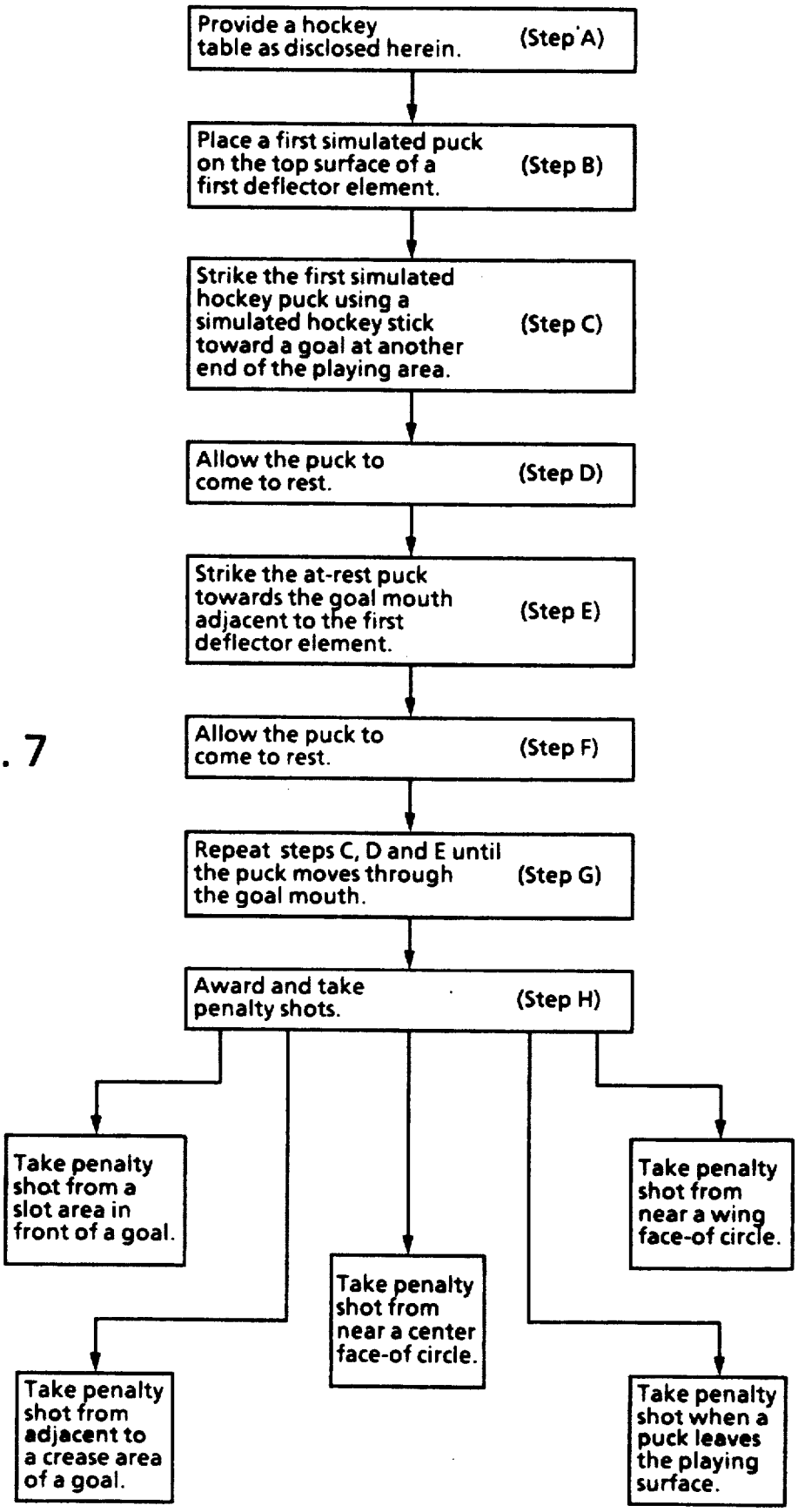
FIG. 7 is a flow diagram illustrating the method of playing the game of the present invention.

As is best shown in FIG. 3, the game also includes a bottom surface 86 having feet 88 thereon so the game can be placed on a table top, and has an outside surface 90 with a planar top rim 92 above which top rim 94 of each goal net extends.

The game is based on ice hockey, and is played according to the rules of ice hockey which have been modified as will be discussed below.

The game is played by two players or two teams, and is begun by each player or team selecting a goal to defend. The players select a player to go first, and that player places a puck 82 on the top surface 72 of the deflector element located in front of the goal he has selected to defend. The player then strikes the puck with his stick 84 towards the opposing player's goal. If the puck goes into that opposing player's goal, the first player is credited with a goal, and the opposing player is given the opportunity to shoot from his deflector element in the just-described manner.

If the initially shot puck does not score a goal, and comes to rest in the playing area as defined by the surface 24 within the perimeter defined by the wall 22, the other player can then shoot the puck back at the initially defended goal from the spot the puck came to rest. If this shot goes in, the shooting player is credited with a goal, and the defending player gets to shoot from his deflector element.

Play continues in this manner until either a set number of goals has been achieved by one player, or a total number of goals has been scored by both players or until a set time expires.

If the players are tied at the end of a set time, for example, a sudden death overtime can be played, wherein the game is played as above discussed and the first player to score a goal wins. The sudden death overtime can be for a set time, and if neither player scores a goal, the game can be called a tie. Series of games can be played with wins counting two points and ties counting one point and a series winner being determined by the number of points a player or team has at the end of a set number of games.

Penalty shots can be awarded from either side face off circle for various actions. For example, if a struck puck goes out of the playing area, the defending player is awarded a penalty shot from the side face off circle closest to the location where the puck left the playing area, or if a player delays the game (as by shooting two consecutive shots out of the playing area), a penalty shot can be awarded from the slot area with the defending player defending that penalty shot. A similar penalty shot from the slot area can be awarded if an offensive player strikes a puck when it is in the crease area, or if a player shoots a puck across two lines (lines 26, 28 or 30) without that puck falling into the defender's slot area. Such two-line penalty shots can be taken from the center face off circle.

The preferred form of the game includes a base which is 24" long by 14" wide by 7" high. The sticks are 6" long, with the deflectors having a diagonal size between the corners of 4". The puck is approximately 1" thick so the deflectors are also approximately 1" thick as measured between the playing surface and the top surface 72 thereof. The surface 24 is a hard plastic surface with a low coefficient of friction for the rubber or plastic puck, and the walls are also plastic so a puck will rebound if it strikes the wall. The deflectors are also hard rubber or plastic which will cause a puck to rebound if it strikes the deflector. The blue lines divide the playing surface into thirds, and the goal is approximately one-third as wide as the playing surface.

It is understood that while certain forms of the present invention have been illustrated and described herein, it is not to be limited to the specific forms or arrangements of parts described and shown.

We claim:

1. A table hockey game comprising: a one-piece monolithic base which includes (1) a rectangular peripheral shape having ends, sides and rounded corners connecting said sides and said ends together, (2) a monolithic, one-piece wall surrounding said base, (3) a playing surface having (a) a width as measured between said sides and a length as measured between said ends, with an imaginary transverse centerline extending widthwise of the playing surface and located midway between said ends and an imaginary longitudinal centerline extending lengthwise of said playing surface and being located midway between said sides, said wall surrounding said playing surface, (b) a center red line extending along said imaginary transverse centerline, (c) two blue lines, one blue line being on each side of said center red line, with a neutral zone being defined between said blue lines and offensive zones being defined between each blue line and one of said ends located adjacent thereto, (d) a center faceoff circle centered on said imaginary transverse centerline and on said imaginary longitudinal centerline, (e) a goal defined in the wall at each end, said goals having a goal mouth with a prescribed width as measured widthwise of the playing area, (f) four wing faceoff circles, each being located adjacent to one of said rounded corners, said wing faceoff circles including a right wing faceoff circle and a left wing faceoff circle adjacent to each goal, with each right wing faceoff circle being centered on an imaginary line that intersects the center of the left wing faceoff circle adjacent thereto, and all faceoff circles having equal diameters, and an imaginary line tangent to the right wing and the left wing faceoff circles for the same goal at the point on such corresponding circles that is closest to the goal being parallel to the blue line defining the offensive zone in which said corresponding right wing and left wing faceoff circles are located, (g) a slot area defined between each of said goals and the blue line defining the offensive zone associated with each of said goals, each of said slot areas having a width equal to the width of each of said goal mouths, (h) a crease area defined adjacent to each of said goal mouths, and (i) a diamond-shaped resilient deflector element located in each of said slot areas in front of each of said goal mouths, each of said deflector elements including a front corner which intersects the blue line defining the offensive zone associated therewith, a rear corner located immediately in front of the goal mouth of each of said goals, a right wing corner which intersects the right wing faceoff circle associated with each of said deflector elements, a left wing corner which intersects the left wing faceoff circle associated with each of said deflector elements, said rear corner lying on the imaginary line which is tangent to both the left wing and the right wing faceoff circles located adjacent to the deflector element, said deflector elements having a diagonal dimension measured between said right wing corner and said left wing corner which exceeds the width of said slot area, each of said deflector elements having a top surface which is spaced above said playing surface and side edges which connect said top surface to said playing surface.

2. The table hockey game defined in claim 1 further including at least one resilient simulated hockey puck.

3. The table hockey game defined in claim 2 further including at least two simulated hockey stick.

4. The table hockey game defined in claim 3 wherein each of said simulated hockey pucks includes a thickness, and each of said deflector elements includes a height which is measured between said top surface and said playing surface which is equal to said simulated hockey puck thickness.

5. The table hockey game defined in claim 4 further including a puck catcher in each goal.

6. The table hockey game defined in claim 5 wherein each goal includes a floor that is coplanar with said playing surface and which extends outwardly of said playing surface along said imaginary longitudinal centerline.

7. The table hockey game defined in claim 6 wherein each puck catcher includes a depression defined in said goal floor.

8. The table hockey game defined in claim 7 further including a net around each of said goals.

9. A method of playing a table hockey game including:

A) providing a table hockey game as defined in claim 8;

B) placing a first simulated hockey puck on the top surface of a first deflector element of said two deflector elements;

C) striking said first simulated hockey puck using one of said simulated hockey sticks toward the goal at the other end of the playing area;

D) allowing the struck simulated hockey puck to come to rest;

E) striking said at-rest simulated hockey puck towards the goal mouth adjacent to said first deflector element;

F) allowing said simulated hockey puck to come to rest; and

G) repeating steps (C), (D) and (E) until said simulated hockey puck has moved through a goal mouth.

10. The method defined in claim 9 further including using penalty shots which include striking the simulated hockey puck towards one of the goals.

11. The method defined in claim 10 wherein one of said penalty shots is taken from the slot area in front of one of said goals.

12. The method defined in claim 11 wherein another penalty shot is taken from adjacent to the crease area of one of said goals.

13. The method defined in claim 12 wherein one penalty shot is taken from near the center faceoff circle.

14. The method defined in claim 13 wherein yet another penalty shot is taken from near one of the wing faceoff circles.

15. The method defined in claim 14 wherein one penalty shot is awarded when the simulated hockey puck leaves the playing surface.

* * * * *